US006290294B1

(12) United States Patent
Volz

(10) Patent No.: US 6,290,294 B1
(45) Date of Patent: Sep. 18, 2001

(54) ANTI-ROCKING SAFETY KIT

(76) Inventor: Dorothy D. Volz, 722 Ashley Forest Dr., Hixson, TN (US) 37343

( * ) Notice: Subject to any disclaimer, the term of this patent is extended or adjusted under 35 U.S.C. 154(b) by 0 days.

(21) Appl. No.: 09/458,969

(22) Filed: Dec. 10, 1999

(51) Int. Cl.[7] ..... A47C 3/03
(52) U.S. Cl. ..... 297/270.5; 297/270.1
(58) Field of Search ..... 297/270.1, 270.3, 297/270.5, 272.1, 272.2, 272.3, 272.4, 463.1, 463.2; 5/106

(56) References Cited

U.S. PATENT DOCUMENTS

| | | | | |
|---|---|---|---|---|
| 169,772 | | 11/1875 | Cadwallader . | |
| D. 309,708 | | 8/1990 | Rosa et al. . | |
| 491,602 | | 2/1893 | Schulte . | |
| 1,223,247 | | 4/1917 | Bolopue . | |
| 1,228,438 | * | 6/1917 | Horan et al. | 188/32 |
| 1,281,867 | * | 10/1918 | Stanton | 188/32 |
| 1,317,329 | * | 9/1919 | Shorday | 188/32 |
| 1,465,852 | * | 8/1923 | Lane | 188/32 |
| 1,912,038 | | 5/1933 | Irish . | |
| 2,376,117 | | 5/1945 | Bright et al. . | |
| 3,664,466 | | 5/1972 | Rotheiser . | |
| 3,810,530 | | 5/1974 | Jay . | |
| 3,993,167 | | 11/1976 | Reed . | |
| 4,021,867 | | 5/1977 | Maxwell . | |
| 4,917,219 | | 4/1990 | Henry . | |
| 5,249,767 | | 10/1993 | Mellen . | |
| 5,564,782 | * | 10/1996 | LaGrange et al. | 297/272.1 X |

* cited by examiner

*Primary Examiner*—Peter R Brown
(74) *Attorney, Agent, or Firm*—Chambliss, Bahner & Stophel, P.C.

(57) ABSTRACT

An anti-rocking safety kit is disclosed for converting or stabilizing rocking devices having rocker arms to non-rocking devices. The kit includes a pair wedges which are capable of quick and easy attachment or detachment to a wide variety of rocking devices having rocker arms. The wedges are secured to the rocking devices using a pair of straps. In addition to its use in preventing a rocking device from rocking, the invention is also capable of reducing the likelihood that a rocking device may be tipped over sideways. The simple design and attachment means allows this invention to be used almost universally with rocking devices having rocker arms.

18 Claims, 3 Drawing Sheets

ANTI-ROCKING SAFETY KIT

FIELD OF THE INVENTION

The present invention relates generally to safety devices, and more particularly to safety devices which are used in conjunction with rocking chairs, rocking horses, cradles and other devices having rockers or rocker arms.

BACKGROUND OF THE INVENTION

Rocking chairs, rocking horses, cradles, and other similar rocking devices are well known and widely used throughout the world. While it is the ability to rock back and forth which makes these devices popular, it is the same rocking ability or instability which may expose numerous individuals to injuries each year. One of the most common problems with rocking devices is their tendency to tip over when a person is attempting to get in or out of the device, as well as when children climb on them while playing. Additionally, situations frequently arise where it would be desirable to use a chair or cradle but for the fact that it rocks. While the prior art addresses a number of concerns which arise from the use of rocking devices, each of the previously-known devices appears to provide a solution to a highly specific problem and does not address the broader range of concerns which affect a larger group of people.

In most cases these known devices are not adaptable to a variety of rocking devices. For instance, C. Schulte's U.S. Pat. No. 491,602 provides for the conversion of a rocking chair to a prayer stand. In making the conversion from a rocking chair to a prayer stand, the seat of the chair is rotated to a vertical position to support a portion of the back as a rest. As the seat is rotated to the proper position, a brace arm is rotated in such a fashion so as to prevent the prayer from rocking forward. Obviously, with its seat in a vertical orientation, the Schulte device may not be used as a chair. Furthermore, the Schulte anti-rocking device does not prevent the prayer stand from rocking backward or the chair from rocking in both directions. Clearly the anti-rocking mechanism disclosed in the Schulte patent is very limited in scope and would only be applicable to the specific embodiment disclosed therein.

Another example of a device which addresses some of the stability and safety concerns related to rocking devices is C. N. Cadwallader's "Convertible Chair" that is described in U.S. Pat. No. 169,772. The Cadwallader device is convertible from a rocking chair to a rocking or non-rocking crib or cradle. Arms G are pivotally hinged to the rockers and are adapted to swing downward so as to bear against the floor for staying the operation of the rockers. While the Cadwallader device need not be "converted" from chair to cradle or vice versa in order to use the anti-rocking arms, the disclosure shows that great care must be taken when attempting to stay the operation of the rockers to ensure that one of the arms G is not dislodged while positioning the others. It also appears that the rockers must be raised off the floor slightly to properly position the anti-rocking arms.

The most noticeable difference between the Schulte and Cadwallader anti-rocking devices is that the Cadwallader device will prevent both forward and rearward rocking when the arms are properly positioned. Additionally, unlike the Schulte device, Cadwallader's invention provides a solution which may be applied to a wide variety of rocking devices; however, Cadwallader's device will still subject its user to undesired rocking or tipping in certain circumstances. For instance, the arms G in Cadwallader merely pivot into position and could become dislodged relatively easily, potentially resulting in undesired rocking or tipping. Furthermore, if the chair or cradle with the anti-rocking feature engaged is moved, the user must check each of the anti-rocking arms to ensure that they are properly positioned and have not become dislodged.

A third example of the representative prior art, Maxwell's "Convertible Cradle" is described in U.S. Pat. No. 4,021,867. The device disclosed in the Maxwell patent comprises a conventional cradle with four pivotally mounted legs that may be used to convert a rocking cradle to a non-rocking cradle. To make the conversion, each of the pivotally mounted legs is rotated in such a manner that the bottom surface of the leg is positioned on the floor surface. A wedge lock pin is used to maintain the proper position of the legs when they are so positioned. Properly positioned, the anti-rocking legs of Maxwell's device raise the cradle's rockers off of the ground, thereby preventing the cradle from rocking. However, Maxwell's device requires the user to lift the rocking cradle off of the ground in order to engage the anti-rocking feature.

OBJECTS OF THE INVENTION

It is an object of the present invention to provide a safety kit which is capable of stabilizing a rocking device and preventing it from rocking.

It is another object of the invention to provide a safety kit which allows for the quick conversion of a rocking device to a non-rocking device or vice versa.

It is another object of the invention to provide a safety kit which attaches to the rocking device in such a manner that if the rocking device is moved, the invention remains in place relative to the rocking device and the risk of undesired tipping or rocking is significantly reduced.

It is a further object of the invention to provide a safety kit which may be attached to rocking devices without requiring the lifting or raising of the device.

It is yet another object of the invention to provide a safety kit which may be adapted for use with a wide variety of rocking devices having rockers, and which may be obtained separately from the rocking device.

Other objects, advantages and features of the present invention will become apparent to those skilled in the art from an examination of the drawings and the ensuing description.

EXPLANATION OF TECHNICAL TERMS

As used herein, the term rocking device refers to a rocking chair, rocking horse, cradle, or any other similar rocking apparatus having at least two rockers or rocker arms which come in contact with the floor surface upon which the rocking device rests and which permit the device to rock back and forth.

As used herein, the terms rockers or rocker arms refer to the components of a rocking device which are generally arcuate in shape and provide the surface upon which the rocking device sits. The arcuate shape of the rockers on a rocking device enables the device to be rocked back and forth along the bottom surfaces of the rockers.

As used herein, the term non-rocking device refers to not only those devices which do not fall into the category of rocking devices, defined above, but also includes those rocking devices which are immobilized in any manner for any length of time such that they are not capable or rocking on their rockers.

SUMMARY OF THE INVENTION

There are a number of times or circumstances at which it is or would be desirable to convert a rocking chair, rocking horse, cradle, or other similar rocking device to a stable, non-rocking device; however, the prior art has not provided nor does it teach or suggest an apparatus for accomplishing this function which may be universally applied to the different types of rocking devices. The present invention provides a solution to the desire to be able to easily convert a rocking device to a non-rocking device, and it addresses some of the concerns of convenience and safety which are associated with that desire. The present invention provides a kit of easily attachable or detachable wedges which may be used with most rocking devices having rocker arms similar to those found on a rocking chair or rocking cradle.

The most basic form of the invention comprises two wedges, each wedge being one piece of material bent, shaped or formed to create a bottom face or surface and an inclined top face. Preferably, each top face is inclined at an angle of approximately 20° with respect to its bottom face. A pair of straps are also provided, each of which is adapted for securing one of the wedges to a rocker of a rocking device.

In use, the first wedge of the kit is slid under one end of one of the rockers of the rocking device with which it is to be used. The wedge should be placed under the rocker arm in such a manner that the bottom face of the wedge is in contact with the floor surface and at least a portion of the inclined top face is in contact with the rocker. Once the wedge is properly positioned, it may be secured in place relative to the rocker by a strap which is preferably attached to the wedge. The strap is designed to be looped over or wrapped around the rocker and attached to the wedge so that the wedge will not slip relative to the rocker. The second wedge of the kit should be positioned and attached to the opposite end of the same rocker or to the opposite end of the other rocker of the rocking device in the same manner as the first.

While the invention is primarily intended to prevent the rocking or tipping of a rocking device in the forward or rearward rocking direction, depending on the size and width of the wedges used, the invention can also reduce the chance of the rocking device tipping sideways, as is most commonly experienced when young children climb on such rocking devices.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout and in which.

DESCRIPTION OF THE PREFERRED EMBODIMENTS OF THE INVENTION

Figure 1:
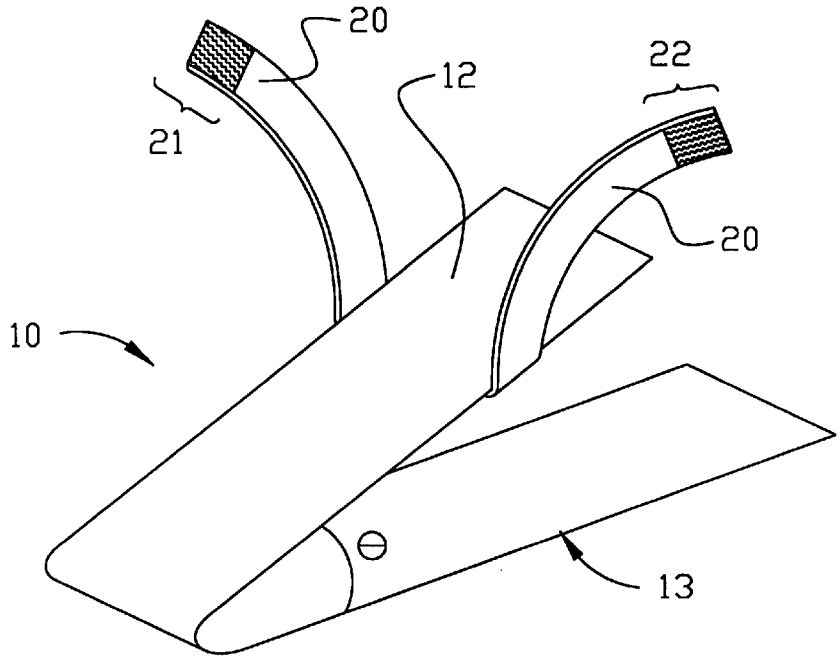
FIG. 1 is perspective view of one embodiment of a wedge of the invention.

Several embodiments of the invention are illustrated in the drawings. While the invention is a kit comprised of at least a pair of wedges or safety blocks, each of the figures (except FIG. 5) illustrates only one wedge. Unless stated otherwise, it should be assumed that the safety wedges of a particular kit are of the same general design as the one which is illustrated and described herein.

FIG. 1 illustrates the simplest form of the invention. As can be seen therein, anti-rocking safety block 10 comprises bottom face 13, inclined top face 12, and elongated strap 20, which is adapted for securing block 10 to a rocker of a rocking device (not shown). Block 10 may be formed of metal or plastic, and strap 20 is preferably made of nylon or similar material. It is also preferred that the strap be attached to the underside of top face 12. The strap may also be glued or cemented to the inclined top face, or it may be attached thereto with a rivet, screw or other mechanical fastener. The strap is provided with a first end 21 and a second end 22, said first end being adapted for attachment to said second end. Preferably, end 21 will be provided with the hook portion of a hook-and-loop type fastener and end 22 will be provided with the corresponding loop portion of the fastener, although the strap may be provided with buckle, snap or other type of closure mechanism (not shown). The strap is provided in a length that is sufficient to wrap around a rocker arm so as to secure block 10 to a rocker.

Figure 2:
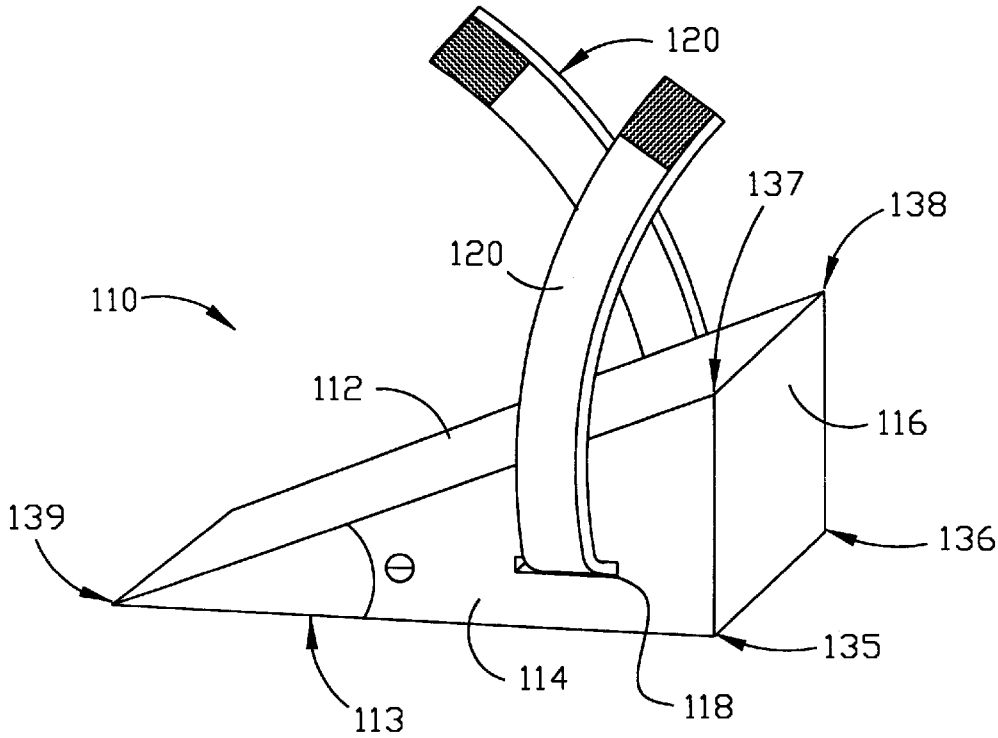
FIG. 2 is a perspective view of a second embodiment of a wedge of the invention.

FIG. 2 shows another embodiment of an anti-rocking safety wedge, namely wedge 110, which includes inclined top face 112, bottom face 113 and end face 116. Wedge 110 also includes a pair of spaced-apart sides (only one of which, side 114, is shown). While spaced apart side 114 and end face 116 are shown as being perpendicular to the bottom face, any number of variations are possible including curved and/or inclined (i.e. non-perpendicular) sides and/or ends. The preferred embodiment of safety wedge 110 also includes an opening 118 defined in each of the sides of the wedge which is adapted to receive an elongated strap 120, so that said strap may be passed through each of said openings beneath the top face.

Figure 3:
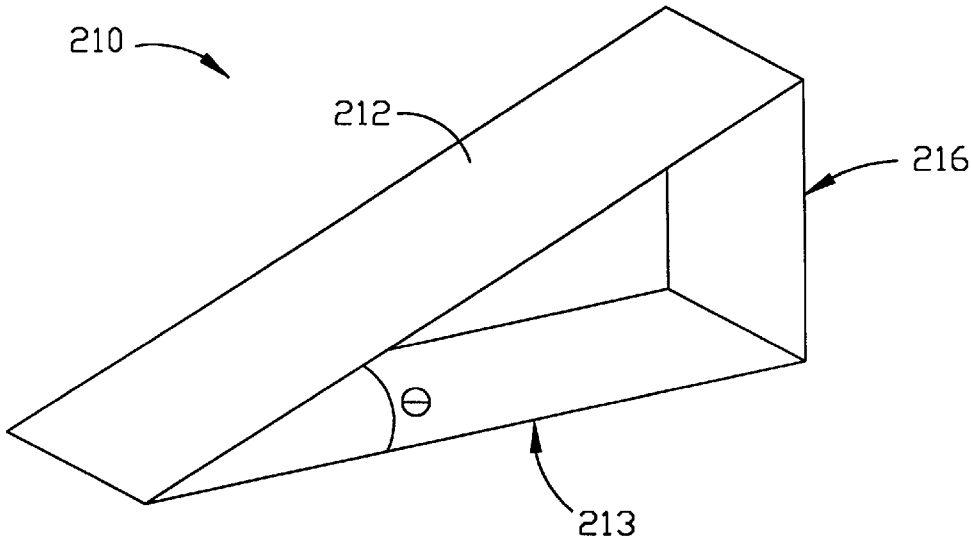
FIG. 3 is a perspective view of a third embodiment of a wedge of the invention.

FIG. 3 illustrates another embodiment of an anti-rocking safety wedge in the form of wedge 210, which includes inclined top face 212, bottom face 213 and end face 216. Such wedge would also be provided with a strap (not shown) for use in attaching the wedge to a rocker arm.

Figure 4:
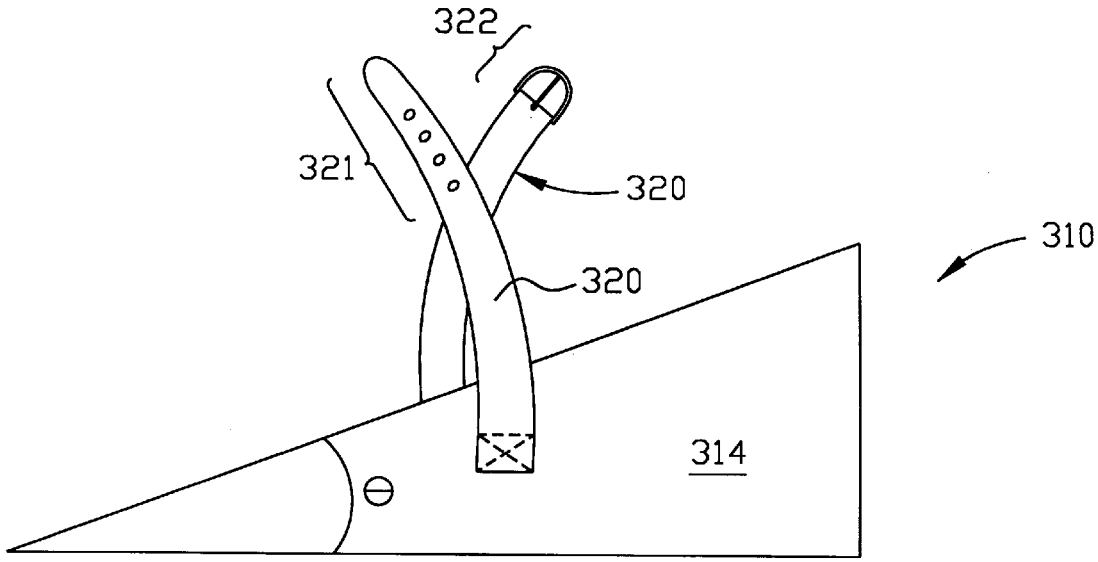
FIG. 4 is a side view of an alternative embodiment of the wedge illustrated in FIG. 2.

FIG. 4 illustrates an alternative embodiment of the wedge of FIG. 2 which does not include opening 118 in its spaced apart sides. As shown in FIG. 4, wedge 310 includes strap 320 that is provided in two portions so that the portion including first end 321 may be fixed to side 314, and the portion including second end 322 may be fixed to the opposing spaced-apart side (not shown) by being stitched thereon, by being glued or cemented thereon or by other known means. Second end 322 is provided with a buckle and first end 321 with a mating strap portion for attachment thereto in order to secure the strap to a rocker arm.

While the invention may be produced in a variety of different sizes and shapes, it is preferred that the top face of each wedge should be inclined at angle of approximately 20° with respect to the bottom face to accommodate the rocker arms of most rocking devices. This angle is represented in FIGS. 1–4 by the symbol Θ. The safety wedges may also be manufactured with incline angles Θgreater than or less than 20° so that rocking devices having non-typical rockers may also be effectively stabilized.

Figure 5:
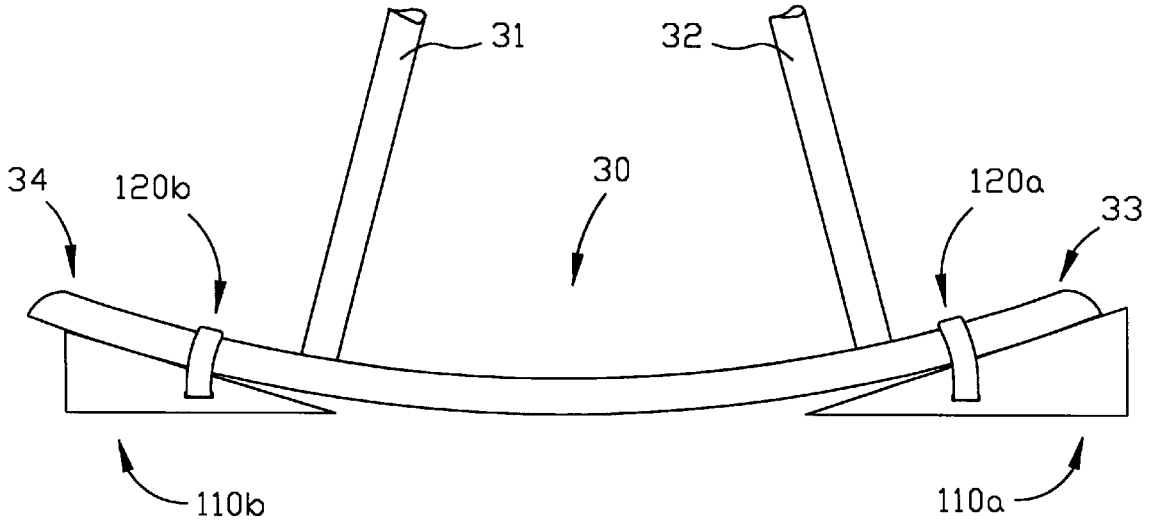
FIG. 5 is a view illustrating a pair of wedges such as are shown in FIG. 2, attached to the rocker arm of a rocking device.

Furthermore, while wedges of the same size may be used, it is preferable that one of each pair of wedges be slightly larger than the other. FIG. 5 illustrates a use of a pair of wedges 110, such as are shown in more detail in FIG. 2, in connection with a rocking device having a rocker arm 30 to which are attached support legs 31 and 32. As shown therein, wedge 110*a*, which is positioned under and attached to front end 33 of the rocker arm is larger than wedge 110*b*. It is preferred that the larger wedge be attached to the front end of the rocker arm because the front end typically has a greater arcuate angle and/or a shorter rocker portion than does the back end 34 of the rocker. Although the illustrations do not reveal the desired dimensions of the wedges, in the preferred embodiment, the larger wedge would measure two inches in height, as measured from one of the corners 135 or 136 (created at the intersection of bottom face 113, end face 116, and one of the spaced-apart sides) to corner 137 or 138, respectively (created at the intersection of inclined top face 112, end face 116, and the spaced-apart sides); six inches in length, as measured from corner 135 to corner 139 (created by the intersection of bottom face 113, inclined top face 112 and side 114); and two inches across, as measured from corner 135 to corner 136 or from corner 137 to corner 138. The preferred dimensions of the smaller wedge are one and one-half inches in height, five inches in length, and two inches in width. Wedges constructed according to the dimensions of the preferred embodiment, with incline angles of about 20°, are sufficient to use in converting most rocking devices having rocker arms to non-rocking devices.

FIG. 5 also illustrates the proper positioning of the wedges with respect to a rocker arm of a rocking device. The bottom surface of both wedges 110*a* and 110*b* rests on and contacts the floor surface (not shown) on which the rocker sits. The larger wedge 110*a* is shown with its inclined top face in contact with the front end 33 of rocker 30, and the smaller wedge 110*b* is shown with its inclined top face in contact with the back end 34 of the rocker. When the wedges are properly positioned as illustrated, the bottom surface of each wedge rests on the floor surface and at least a portion of its inclined top face is in contact with the rocker. For best stabilization and minimal wobble, each wedge should be gently pushed under the rocker slightly past the point that first contact is made between the inclined top face and the underside of the rocker. Although FIG. 5 illustrates wedges 110*a* and 110*b* under opposite ends of the same rocker, if properly positioned, the wedges may also be placed under opposite ends of different rockers (not shown).

Once the wedges are properly positioned with respect to the rocker 30, the user should loop one end of each of elongated straps 120*a* and 120*b* over the top of the rocker and secure it to the other end of the strap, tightening the strap as necessary. The ends of the strap should be attached in such a manner that the strap fits snugly over the rocker and in such a manner that the wedge will not move from its position relative to the rocker until the strap is disengaged.

While much of the detailed description of this invention refers only to a pair of wedges being used to stabilize the chair, it should be noted that for maximum stabilization and to further decrease the chance that a rocking device may be tipped over sideways while the safety wedges are in use, four wedges should be used, one under each end of each of the rockers on the rocking device. Furthermore, it should be noted that one end of the strap could be quite short, and could even consist merely of a buckle, hook and loop fastener patch, or any other known fastening means which is compatible with the other end of the strap and which is attached to a spaced-apart side or otherwise to the wedge (not shown). In such case, the other (longer) end of the strap may be wrapped over the rocker and secured to the fastening means in such a manner so as to allow the wedge to be secured to the rocker. It is also possible for both ends of the strap to be fixed to opposite sides of the wedge (not shown) so as to form a loop therein, especially where the strap is made of elastic material. Where both ends of the strap are fixed to the wedge, the user must slide an end of the rocker through the loop formed by the strap before positioning the wedge under the rocker.

Referring once again to FIG. 5, once properly positioned and secured to rocker 30, wedges 110*a* and 110*b* will remain in position relative to the rocker until the straps 120*a* and 120*b* are disengaged. A rocking device to which the anti-rocking safety kit of the invention is properly attached may be moved from one location to another without repositioning or realigning the anti-rocking mechanism.

The design of the invention allows the wedges to be made of any material which can be made to conform to the dimensions of the rocker arms found on typical rocking devices and to provide adequate anti-rocking support. When a safety wedge is in place under a rocker, at least a portion of the inclined face will be in contact with the underside of the rocker. The wedges of the preferred embodiment of the invention will be made of a material having a high resistance to compression, such that when, for example, a person leans back in a chair which has the wedges secured thereto (or if he leans forward to get up out of the chair), the wedge will give only slightly (if at all) such that the chair or other rocking device does not rock. After the pressure applied to the wedges is discontinued, if the wedge was deformed, the wedge should return to its original shape such that the inclined top face remains in contact with the underside of the rocker at all times. While it is ideal that the material which is used to make the safety wedges would not permit even the slightest forward or rearward rocking movement, by using a material which permits a slight compression, such as a high density rubber, the rocking motion will be minimized and damage to the rockers will also be prevented. In the alternative, the inclined top faces and the bottom faces of the wedges may be covered with a protective covering such as a plastic that will prevent marring the surface of the rocker arm or the floor.

Although this description contains many specifics, these should not be construed as limiting the scope of the invention but merely as providing illustrations of the some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. An anti-rocking safety kit for use with a rocking device that is adapted to sit on a floor surface, said rocking device having a first and a second rocker, with each of said rockers having a front end and a rear end, said safety kit comprising:

(a) a first wedge and a second wedge, wherein each of said wedges has a bottom face and an inclined top face and wherein the first wedge is longer than the second wedge;

(b) a pair of elongated straps, each of which is adapted to extend from a wedge around a rocker so as to secure one of the wedges to a rocker of a rocking device; wherein the first wedge is adapted to be positioned under one end of one of the rockers with its bottom face in contact with the floor surface and at least a portion of its inclined top face in contact with the rocker and the second wedge is adapted to be positioned under the opposite end of one of the rockers with its bottom face in contact with the floor surface and at least a portion of its inclined top face in contact with the rocker in order to prevent the rocking device from rocking, and wherein the strap of each wedge may be wrapped around a portion of the end of the rocker with which it is associated to secure the wedge to the rocker.

2. The anti-rocking safety kit of claim 1 wherein a strap is attached to each of the wedges.

3. The anti-rocking safety kit of claim 1 further comprising:

(a) a third wedge, and a fourth wedge, wherein each of said wedges has a bottom face and an inclined top face;

(b) a second pair of elongated straps, each of which is adapted to extend from a wedge around a rocker so as to secure one of the wedges to a rocker of a rocking device;

wherein the third wedge is adapted to be positioned under one end of one of the rockers with its bottom face in contact with the floor surface and at least a portion of its inclined top face in contact with the rocker and the fourth wedge is adapted to be positioned under the opposite end of one of the rockers with its bottom face in contact with the floor surface and at least a portion of its inclined top face in contact with the rocker in order to prevent the rocking device from rocking, and wherein the strap of each wedge may be wrapped around a portion of the end of the rocker with which it is associated to secure the wedge to the rocker.

4. The anti-rocking safety kit of claim 1 wherein each of the straps includes a first end and a second end, said first end being adapted for attachment to said second end so that the first end may be attached to the second end to secure the wedge with which the strap is associated to an end of a rocker.

5. The anti-rocking safety kit of claim 4 wherein the first end of each of the straps is provided with a hook portion of a hook and loop fastener, and the second end is provided with the loop portion of a hook and loop fastener, said hook portion and said loop portion being adapted to attach the first end to the second end.

6. The anti-rocking safety kit of claim 1 wherein the inclined top face of each of the wedges is inclined at an angle of approximately 20° with respect to the bottom face.

7. The anti-rocking safety kit of claim 1 wherein each of the wedges has an end face and a pair of spaced-apart sides.

8. The anti-rocking safety kit of claim 7 wherein each of the wedges has an opening defined in each of the sides thereof, which openings are adapted to receive the strap so that said strap may be passed through each of said openings beneath the top face.

9. A method of preventing the rocking of a rocking device that is adapted to sit on a floor surface, said rocking device having a first and a second rocker, with each of said rockers having a front end and a rear end, which method comprises:

(a) providing an anti-rocking safety kit, said safety kit comprising:

(i) a first wedge and a second wedge, wherein each of said wedges has a bottom face and an inclined top face;

(ii) a pair of elongated straps, each of which is adapted to extend from a wedge around a rocker so as to secure one of the wedges to a rocker of a rocking device;

(b) positioning the first wedge under one end of one of the rockers with its bottom face in contact with the floor surface, and at least a portion of its inclined top face in contact with the rocker;

(c) positioning the second wedge under the opposite end of one of the rockers with its bottom face in contact with the floor surface and at least a portion of its inclined top face in contact with the rocker;

(d) wrapping the strap of each wedge around a portion of the end of the rocker with which it is associated.

10. The method of claim 9 which includes providing a pair of elongated straps, each of which includes a first end and a second end, said first end being adapted for attachment to said second end so that the first end of each of the straps may be attached to the second end of said strap to secure the wedge with which the strap is associated to an end of a rocker.

11. The method of claim 10 which includes attaching the first end of each of the straps to the second end of said strap to secure the wedge with which the strap is associated to an end of a rocker.

12. The method of claim 9 which includes providing an anti-rocking safety kit in which a strap is attached to each of the wedges.

13. The method of claim 9 which includes providing an anti-rocking safety kit having wedges in which the inclined top face is inclined at an angle of approximately 20° with respect to the bottom face.

14. The method of claim 9 which includes providing an anti-rocking safety kit in which the first wedge is longer than the second wedge.

15. The method of claim 9 which includes providing an anti-rocking safety kit in which each of the wedges has an end face and a pair of spaced-apart sides.

16. The method of claim 9 which includes providing an anti-rocking safety kit in which each of the straps includes a first end and a second end, said first end being adapted for attachment to said second end so that the first end may be attached to the second end to secure the wedge with which the strap is associated to an end of a rocker.

17. The method of claim 16 which includes providing an anti-rocking safety kit in which each of the wedges has an opening defined in each of the sides thereof, which openings are adapted to receive the strap so that said strap may be passed through each of said openings beneath the top face.

18. The method of claim 16 which includes providing an anti-rocking safety kit in which the first end of each of the straps is provided with a hook portion of a hook and loop fastener, and the second end is provided with the loop portion of a hook and loop fastener, said hook portion and said loop portion being adapted to attach the first end to the second end.

* * * * *